US012709859B2

(12) United States Patent
Rodriguez et al.

(10) Patent No.: US 12,709,859 B2
(45) Date of Patent: Aug. 18, 2026

(54) SEALED HATCH ASSEMBLY FOR UNDERGROUND ENCLOSURE

(71) Applicant: USF Fabrication, Inc., Hialeah, FL (US)

(72) Inventors: Daniel Rodriguez, Miami, FL (US); Jamie Gomez, Pembroke Pines, FL (US); Jorge Landrian, Miami Lakes, FL (US)

( * ) Notice: Subject to any disclaimer, the term of this patent is extended or adjusted under 35 U.S.C. 154(b) by 0 days.

(21) Appl. No.: 18/222,917

(22) Filed: Jul. 17, 2023

(65) Prior Publication Data

US 2025/0179757 A1 Jun. 5, 2025

(51) Int. Cl.
*E02D 29/14* (2006.01)

(52) U.S. Cl.
CPC ..... *E02D 29/149* (2013.01); *E02D 29/1463* (2013.01); *E02D 29/1427* (2013.01)

(58) Field of Classification Search
CPC ..... E02D 29/149
See application file for complete search history.

(56) References Cited

U.S. PATENT DOCUMENTS 1,847,335 A * 3/1932 Farch ..... E06B 7/24 49/473
2,137,751 A * 11/1938 Davis ..... E04D 13/0354 16/288
3,045,632 A * 7/1962 Hecht ..... B63B 19/26 160/188
4,266,380 A * 5/1981 Samolis ..... E02D 29/1463 404/25
4,567,697 A * 2/1986 Hahne ..... E02D 29/14 404/25
4,608,780 A * 9/1986 Van Noy ..... A47L 15/4263 49/483.1
4,811,680 A * 3/1989 Genth ..... B63B 19/14 114/211
5,076,188 A * 12/1991 Burroughs ..... B63B 19/14 49/501
5,090,713 A * 2/1992 Johnson ..... F16J 15/106 277/648
5,201,151 A * 4/1993 LeBlanc ..... E02D 29/149 52/21

(Continued)

FOREIGN PATENT DOCUMENTS

DE 102012210583 A1 * 12/2013 ..... E06B 7/16
FR 3119405 A1 * 8/2022

(Continued)

*Primary Examiner* — Catherine A Kelly
(74) *Attorney, Agent, or Firm* — GrayRobinson, P.A.

(57) ABSTRACT

Disclosed is a hatch assembly with a gasket that seals when the hatch is closed. The sealed hatch assembly is fluid tight and prevents water, dust, or other contaminates from entering the enclosure protected by the hatch. In a preferred embodiment, the gasket is formed about a peripheral edge of the hatch door. This gasket is adapted to seat upon an L-shaped bracket formed about the periphery of the hatch frame. A center beam is also included for dividing the frame into two openings. The center beam includes a U-shaped bracket that can also form a seal with the gasket. The various components of the present disclosure, and the manner in which they interrelate, will be described in greater detail hereinafter.

10 Claims, 6 Drawing Sheets

(56) References Cited

U.S. PATENT DOCUMENTS 5,205,073 A * 4/1993 Lyons, Sr. ..... E02D 29/1418 52/72
5,240,346 A * 8/1993 Yin ..... E02D 29/149 404/25
5,597,263 A * 1/1997 Bravo ..... E02D 29/14 404/26
5,600,921 A * 2/1997 Vardaro ..... E05C 9/047 49/386
5,649,399 A * 7/1997 Kepets ..... E02D 29/14 52/471
6,021,606 A * 2/2000 Kos ..... E05F 1/1058 49/386
6,260,305 B1 * 7/2001 Joyce ..... E06B 7/231 49/489.1
6,688,807 B2 * 2/2004 Navarrete ..... E02D 29/1427 404/25
7,216,459 B1 * 5/2007 Akkala ..... E05F 1/1016 49/386
7,491,010 B2 * 2/2009 Cuny ..... E02D 29/14 404/25
8,166,706 B2 * 5/2012 Slimak ..... E05B 65/006 16/361
8,844,202 B2 9/2014 Carralero
9,303,441 B2 * 4/2016 Bravo ..... E05F 1/1058
9,476,251 B2 * 10/2016 Olch ..... E02D 29/1454
9,982,476 B2 * 5/2018 Clarke, Jr. ..... E06B 1/524
10,132,052 B2 * 11/2018 Dang ..... B65D 57/00
10,550,540 B2 * 2/2020 De Siena ..... E02D 29/14
10,774,576 B1 * 9/2020 Vonnahme ..... E05F 3/10
11,536,003 B1 * 12/2022 Forlong ..... B05D 1/26
2015/0135599 A1 * 5/2015 Mares ..... E06B 5/01 49/465
2023/0332371 A1 * 10/2023 Clements ..... F16B 2/14
2024/0240424 A1 * 7/2024 Cathey ..... E02D 29/1418

FOREIGN PATENT DOCUMENTS

GB 2173238 A * 10/1986 ..... E06B 7/2301
GB 2194814 A * 3/1988 ..... E06B 5/18
GB 2395217 A * 5/2004 ..... E02D 29/1427

* cited by examiner

SEALED HATCH ASSEMBLY FOR UNDERGROUND ENCLOSURE

TECHNICAL FIELD

This disclosure relates to a hatch assembly. More particularly, the present disclosure relates to a hatch assembly with an improved seal to reduce the intrusion of contaminants.

BACKGROUND OF THE INVENTION

Hatches, or access doors, are commonly used to secure the openings to a variety of above ground or underground enclosures. For underground enclosures, the hatch is mounted within the ground. Underground enclosures are often used to house large municipal equipment, such as pumps, transmission lines, or pipes. These underground enclosures require a ground mounted hatch that includes a door that is pivotally connected to a surrounding frame. The door must be heavy enough to support foot and vehicle traffic. For this reason, various lift assist devices can be included to enable a single user to pivot the door to its opened position. The door must also open widely enough to allow a variety of large and heavy equipment to be loaded into the enclosure. The door ideally provides some degree of theft deterrence. Various efforts have been made over the years to improve the design and construction of access doors.

One example of such a door is U.S. Pat. No. 8,844,202 to Carralero. Carralero is commonly owned with the present application and discloses a latching mechanism for an access door. The door is ground mounted and can be pivoted between opened and closed positions. The opened position is retained with the assistance of a hold open arm. A latching lever works in connection with the hold open arm. Another example is U.S. Pat. No. 9,303,441 to Bravo. Bravo, which is also commonly owned with the present application, discloses a lift assist mechanism for an access door. The door includes opened, closed, and partially opened positions. Each of these positions is achieved with the assistance of compression springs associated with the door.

Although the background art illustrates various helpful improvements in the field of hatches, none of the background art adequately addresses improved sealing mechanisms for the door. Thus, there is a need in the art for a sealed hatch design with the ability to reduce the intrusion of contaminants, such as water, dust, and debris into the associated enclosure. The sealed hatch assembly of the present disclosure is designed to fulfill these and other shortcomings present in the background art.

SUMMARY OF THE INVENTION

Disclosed is a hatch assembly with a pivotally mounted door. The door includes a surrounding gasket that cooperates with an upstanding bracket within the hatch frame upon closure. The position of the hinges allows the door to seal as it begins to close. Once fully closed, the gasket provides a peripheral and fluid tight seal that reduces or eliminates the instruction of water, dust, or other contaminants. This, in turn, allows for the protection of the equipment within the enclosure.

The disclosed access door has several important advantages. One advantage is provided by an elastomeric seal within the periphery of the door that can engage a corresponding L-shaped bracket within the periphery of the frame. When the door is closed, the bracket engages the seal to provide a fluid tight connection.

Another advantage is provided by the hinge connecting the door to the surrounding frame. This hinge is provided at a lower position with respect to the frame, whereby a fluid tight seal is formed following the earliest rotation of the door. Thereafter, the entire periphery of the door is sealed when the door is fully closed.

Yet another advantage is provided by a center beam that is provided across the opening of the enclosure. This center beam includes removable gaskets at either end to provide a fluid tight connection between the beam and the frame. The frame can be removed to allow large equipment to be positioned within the enclosure.

A still further advantage is achieved by providing a peripheral seal that is formed from a relatively soft and compressible material.

In particular, an advantage is realized by forming the seal from a silicone with a Shore A hardness of 10 as measured in accordance with the ASTM D2240 standard.

Yet another advantage is realized by providing a hatch that can be closed and sealed within a minimal number of cam locking mechanisms.

These and other advantages are achieved via an elastomeric gasket that is formed about the entire peripheral edge of the hatch door. This gasket is adapted to seat upon an L-shaped bracket formed about the periphery of the hatch frame. A center beam is also included for dividing the frame into two openings. The center beam includes a U-shaped bracket that can also form a seal with the gasket.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

PARTS LIST

| | |
|---|---|
| 10 | Hatch Assembly |
| 12 | Opening |
| 14 | Enclosure |
| 22 | Frame |
| 24 | Lengthwise Edge |
| 26 | Widthwise Edge |
| 28 | Midpoint of Lengthwise Edge |
| 32 | Inner Peripheral Edges of Frame |
| 34 | L-Shaped Bracket |
| 36 | Center Beam |
| 38 | U-Shaped Bracket |
| 42 | First Opening |
| 44 | Second Opening |
| 46 | First Door |
| 48 | Second Door |
| 50 | Beam Gasket |
| 52 | Hinge Assembly |
| 54 | Peripheral Edge of Doors |
| 56 | Gasket |
| 58 | Sealed Bolt |
| 62 | Head Washer |
| 64 | Shaft Washer |
| 66 | Cam lock |
| 68 | Cam lock Lever |
| 72 | Cam lock Stop |

DETAILED DESCRIPTION OF THE DRAWINGS

The present disclosure relates to sealed hatch assembly. The assembly includes a pivotal door with a peripherally mounted gasket. The assembly further includes a frame with an upstanding bracket that fits into the gasket when the door is closed. With the door closed, the hatch assembly is fully sealed to prevent the intrusion of water, dust, or other contaminants. In a preferred embodiment, a beam is included for dividing the frame into two equally sized openings. In this embodiment, a door is mounted within each of the openings. The center beam includes an upstanding U-shaped bracket, with each side of the U-shaped bracket engaging the gasket along the forward edge of the corresponding door. Additional gaskets can be mounted at the ends of the beam to provide further sealing. The various components of the present disclosure, and the manner in which they interrelate, will be described in greater detail hereinafter.

Figure 1A:
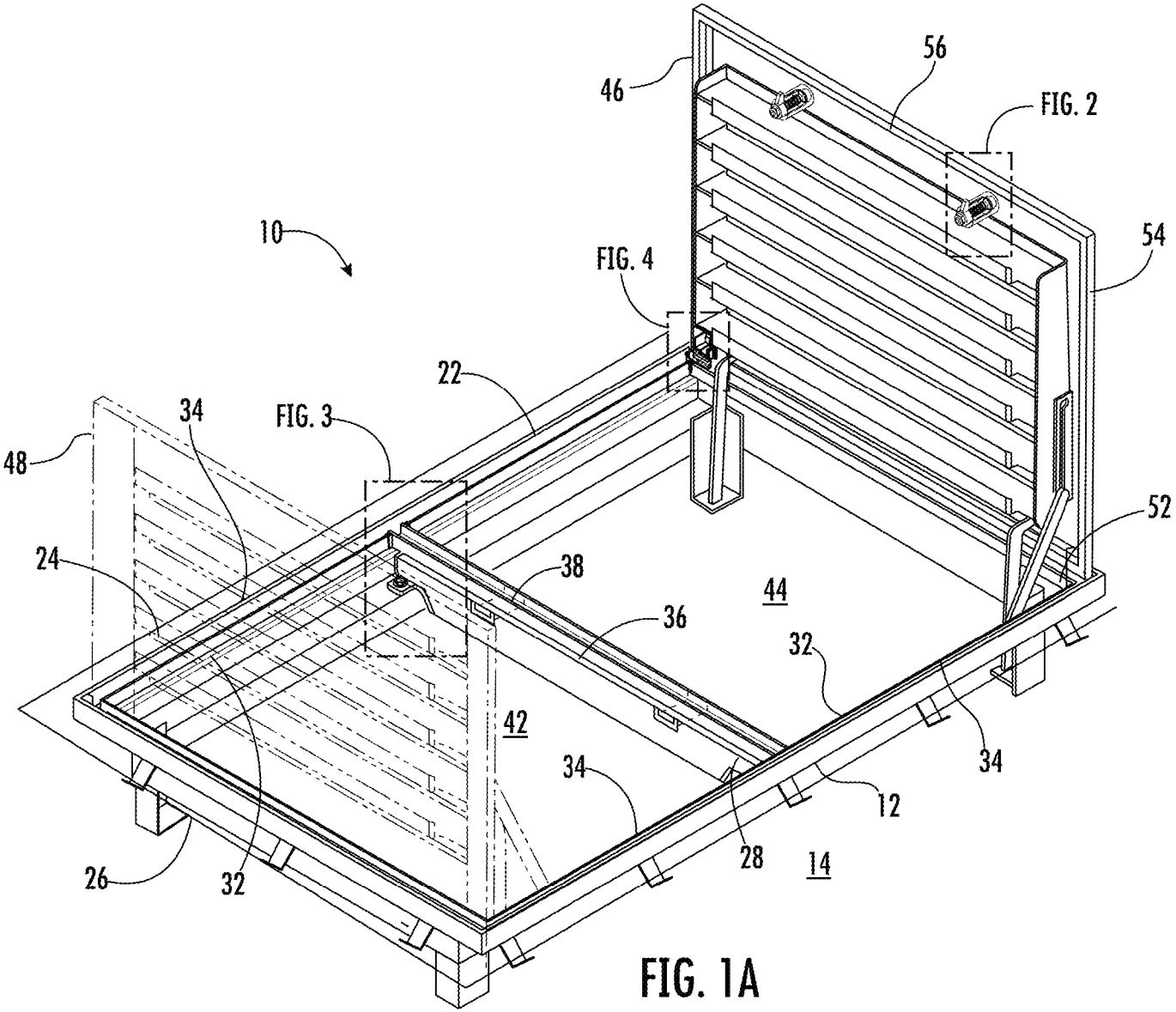
FIG. 1A is a perspective view of a two-door hatch assembly of the present disclosure.

With reference to FIG. 1A, the sealed hatch assembly (10) is illustrated. Hatch assembly (10) is adapted to be positioned over the opening (12) for an underground enclosure (14). This underground enclosure may house various municipal equipment, such as pumps, electric equipment, or pipes. When used for underground enclosures, the upper surface of hatch assembly (10) is strong enough to be driven over by heavy vehicles. However, the hatch assembly (10) of the present disclosure can likewise be used in connection with a variety of above ground enclosures.

Hatch assembly (10) includes a peripheral frame (22) that is defined by opposing lengthwise and widthwise edges (24, 26). Although the depicted frame (22) is rectangular, frame (22) can be sized or dimensioned to fit any of a variety of openings. The opposing lengthwise edges (24) having both a length and a midpoint (28). For the depicted embodiment, frame (22) is dimensioned to be securely fitted within the opening (12) of the underground enclosure (14). An inner peripheral extent (32) is formed along the entire length of the opposing lengthwise and widthwise edges (24, 26). An upstanding L-shaped bracket (34) is secured along this inner peripheral extent (32). As described below, the upper edge of this L-shaped bracket (34) is adapted to fit within a peripheral gasket within the pivotal door. The depicted L-shaped bracket (34) is bolted to the peripheral extent (32) about the entire periphery of frame (22). However, it is also within the scope of the present disclosure to form bracket (34) integrally with frame (22).

FIG. 1A further illustrates a beam (36) that can optionally be included within frame (22) and that serves to divide the opening (12) of frame (22) into two smaller openings (42, 44). In the depicted embodiment, beam (36) extends centrally between the midpoint (28) of the lengthwise edges (24) to divide opening (12) into two equally sized openings (42, 44). Doors (46, 48) are pivotally mounted to frame (22) and within these openings (42, 44) to selectively close them. The exact position of beam (36) can be adjusted according to the needs of the user and the disclosure is not limited to equally spaced openings. It is also within the scope of the present disclosure to use more than one beam (36) to divide the opening (12) into several smaller openings. Doors (46, 48) include peripheral edges that can be press broke at a 90-degree angle to the upper door surface. This greatly increases the strength of the doors.

Figure 3A:
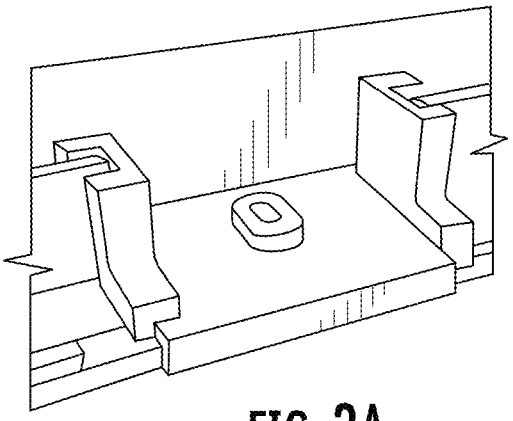
FIG. 3A is a detailed view of the beam gasket positioned upon center beam FIG. 1A.
Figure 3B:
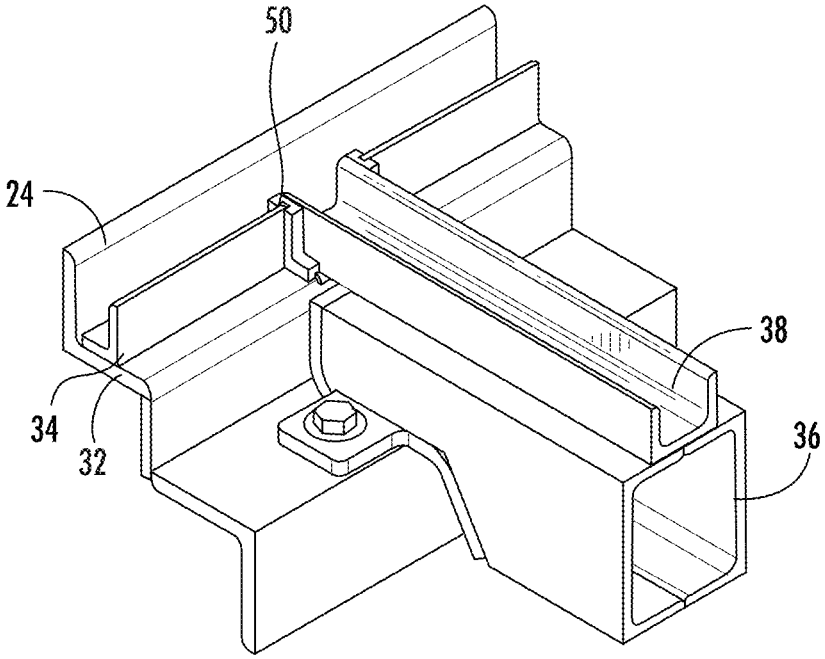
FIG. 3B is a detailed view of the center beam and gasket taken from FIG. 1A.

Center beam (36) includes an upstanding U-shaped bracket (38) that extends between the opposing L-shaped brackets (34) on each lengthwise edge (24). As noted in FIG. 3B, the U-shaped bracket (38) is mounted to the top surface of center beam (36). The U-shaped bracket (38) can be bolted in place or formed integrally with the surface of center beam (36). As best depicted in FIG. 3B, each end of the U-shaped bracket (38) intersects with one of the corresponding L-shaped brackets (34). A U-shaped beam gasket (50) is secured to an inner peripheral extent (32) of each lengthwise edge (24). As illustrated in FIG. 3B, each end of the center beam (38) is bolted to frame (22). This allows center beam (38) to be removed, as may be needed when larger equipment is being moved into the enclosure (14).

Gasket (50) used upon center beam (38) includes a centrally located and molded aperture to allow the gasket (50) to be secured to peripheral extent (32) via a threaded fastener. Gasket (50) further includes upstanding side edges within channels that accept the edges of the L-shaped bracket (34). These U-shaped gaskets (50) are positioned at the interface of the L-shaped bracket (34) and the U-shaped bracket (38) and prevent contaminant intrusion at this interface. Beam gasket (50) is depicted in FIG. 3A and is preferably integrally molded from a silicone polymer material. In the preferred embodiment, beam gasket (50) is formed from a silicone with a Shore A hardness of 10 as measured in accordance with the ASTM D2240 standard. Any of a variety of silicone materials manufactured by Smooth-On, Inc. of Macungie, Pennsylvania will suffice in this regard.

Figure 1B:
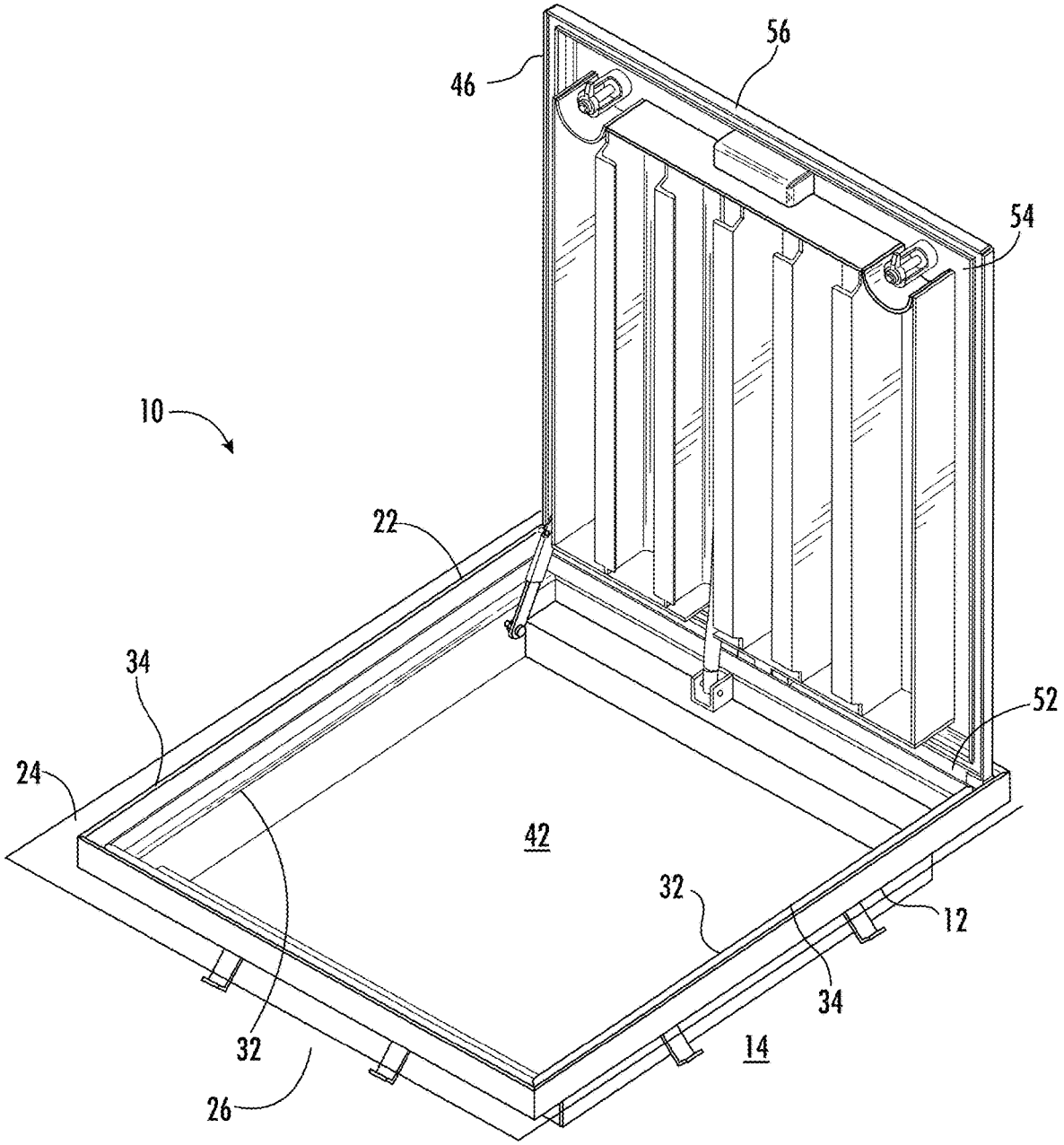
FIG. 1B is a perspective view of a single-door hatch assembly of the present disclosure.
Figure 2:
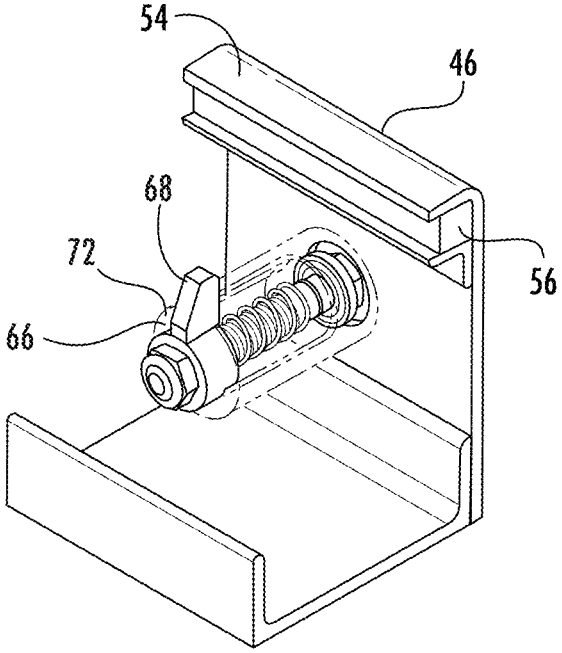
FIG. 2 is detailed view of the cam lock taken from FIG. 1A.

With reference again to FIG. 1A, the preferred and depicted embodiment of hatch assembly (10) utilizes two opposing and equally sized doors (46, 48). Each door (46, 48) acts as a closure for one side of opening (42, 44) within frame (22). Each of these doors (46, 48) is pivotally secured to one of the opposing widthwise (26) edges of frame (22) via a corresponding hinge assembly (52). As such, doors (46, 48) each have opened and closed positions over a respective opening (42, 44). However, the present disclosure is not limited to the use of two doors and any number of doors can be employed. For example, FIG. 1B illustrates a one-door embodiment. This embodiment is the same in all material respects as the two-door embodiment of FIG. 1A.

Each of the opposing doors (46, 48) includes a peripheral edge (54) that may take the form of a U-shaped channel. A silicone rubber gasket (56) is formed within this channel, which extends around the entire peripheral extent of each door (46, 48). In the preferred embodiment, gasket (56) is formed from a silicone with a Shore A hardness of 10 as measured in accordance with the ASTM D2240 standard. Any of a variety of silicone materials manufactured by Smooth-On, Inc. of Macungie, Pennsylvania will suffice in this regard.

Figure 4A:
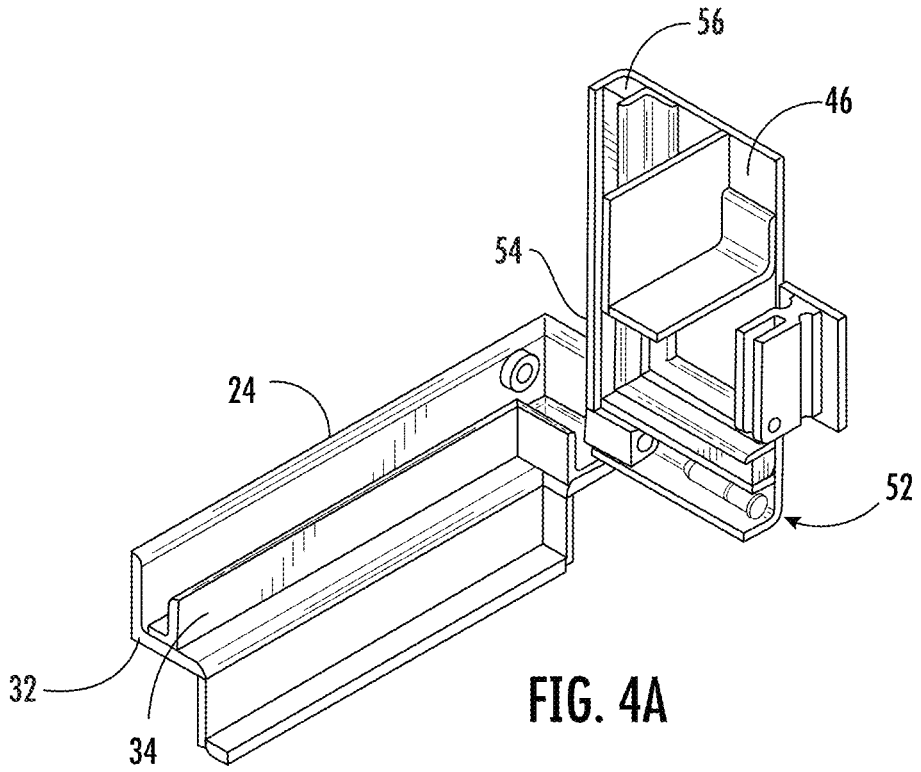
FIG. 4A is an exploded view of the hinge assembly taken from FIG. 1A.
Figure 4B:
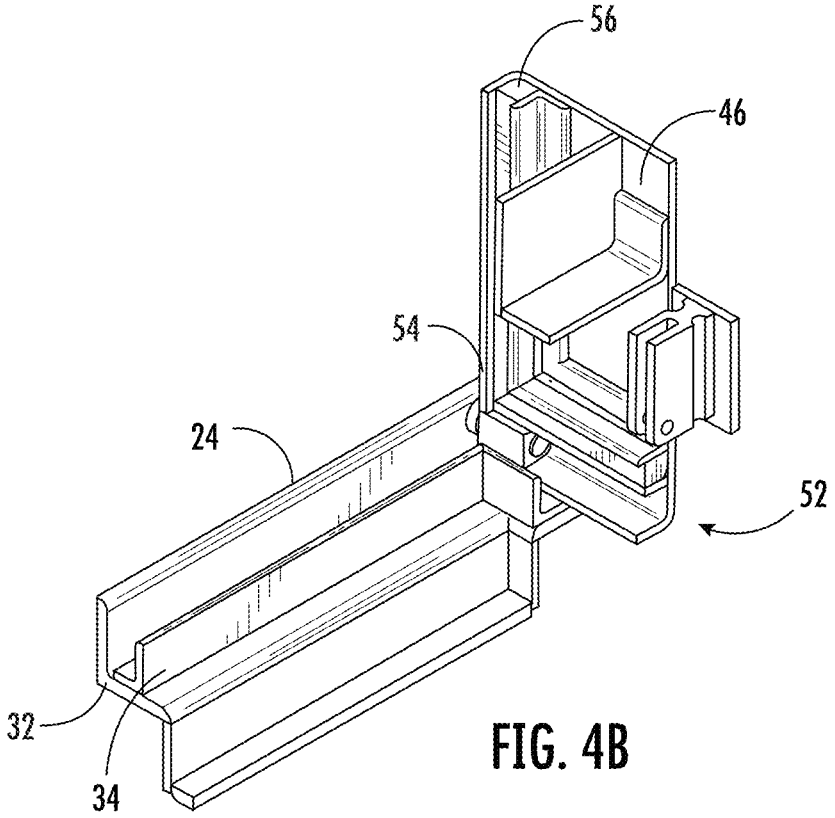
FIG. 4B is a perspective view of the assembled hinge assembly taken from FIG. 1A.
Figure 5:
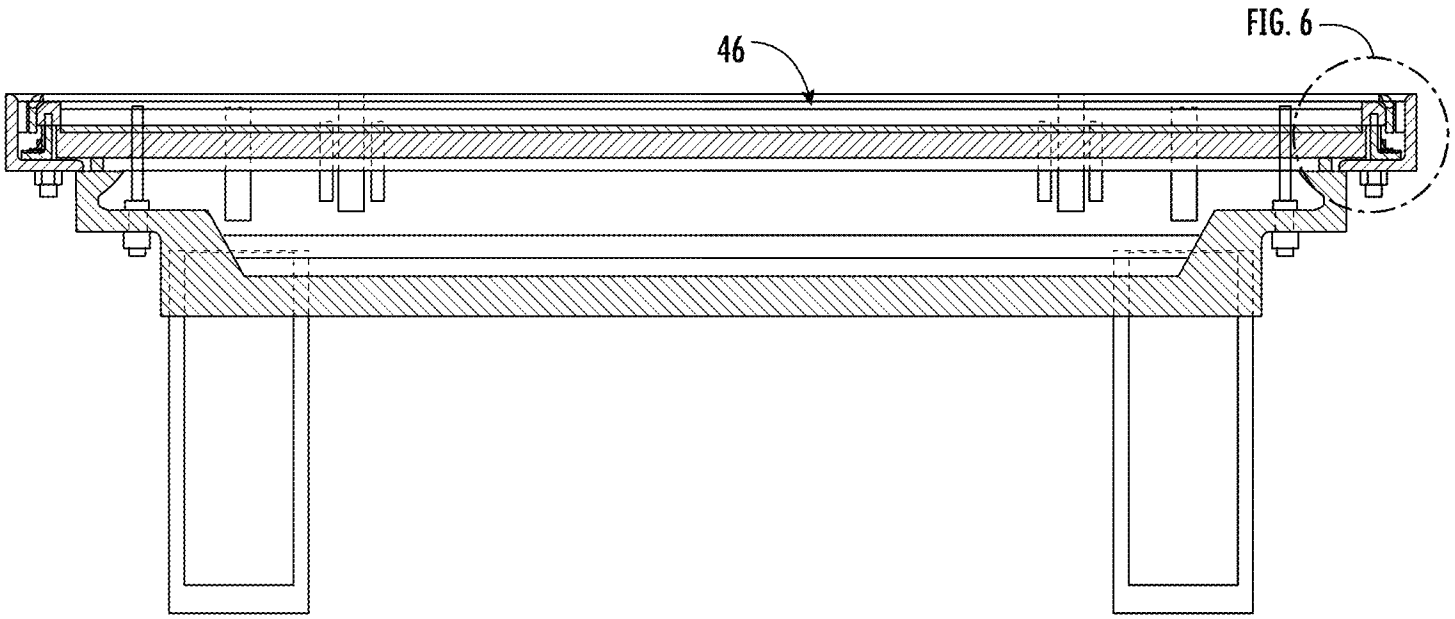
FIG. 5 is a sectional view of the hatch assembly with the door closed.
Figure 6B:
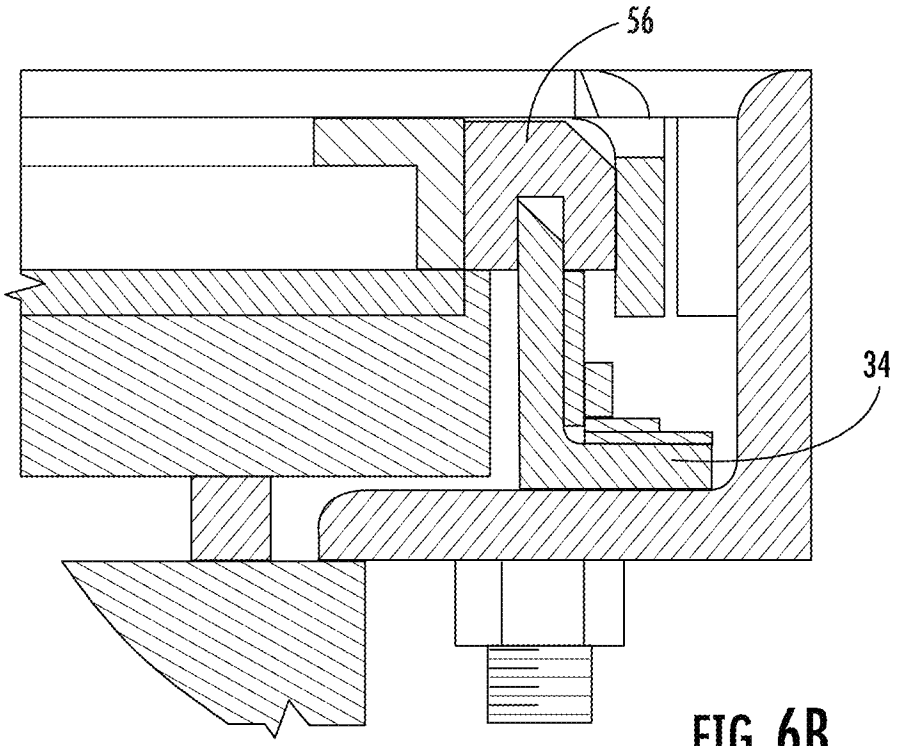
FIG. 6B is a detailed view of the seal formed upon closure of the hatch assembly as taken from FIG. 5

In use, when either door (46, 48) is closed, the silicon gasket (56) around the periphery of each door (46, 48) engages the L-shaped (34) and U-shaped (38) brackets. Namely, three sides of each door (46,48) engage the L-shaped bracket (34) within the frame (22) whereas the forward edge of each door (46, 48) engages one side of the U-shaped bracket (38) upon the center beam (36). In each case, and as best illustrated in FIG. 6B, an upper edge of each bracket (34, 38) is pressed into silicon gasket (56) to form a fluid tight seal. The relationship between the gasket (56) and the L-shaped bracket (34) is best illustrated in FIG. 6B. A similar relationship is formed between U-shaped bracket (38) and gasket (56). Thus, as illustrated in FIG. 5, with door (46, 48) closed over frame (22) contaminants are precluded from entering the interior of enclosure (14). Additionally, as illustrated in FIGS. 4A-4B, hinge assembly (52) is at a lower position within frame (22). This allows L-shaped bracket (34) to immediately engage gasket (56) within the corner, peripheral edge (54) of the door (46, 48) upon the initial rotation of door (46, 48). As such, a seal is immediately formed upon the closure of either door (46, 48).

Figure 6A:
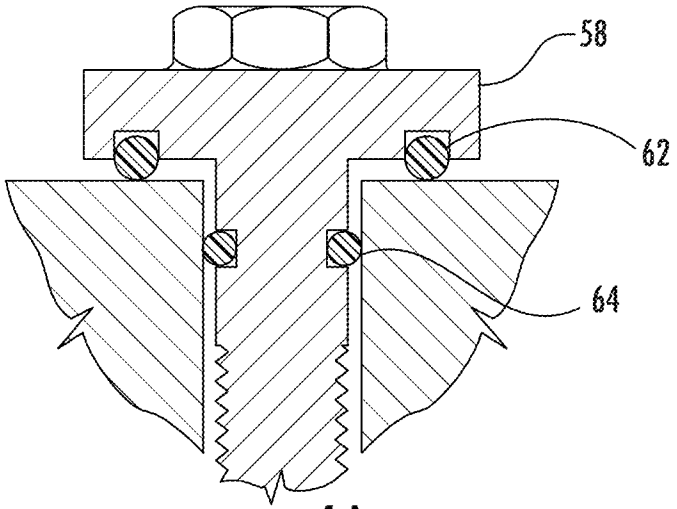
FIG. 6A is a detailed view of a sealing arrangement for one of the bolts utilized by the enclosure.

FIG. 6A illustrates the sealing arrangement that can be used for the bolts that fasten frame (22) to the enclosure (14). Specifically, a sealing bolt (58) is provided with a flanged head and a recess within which a head washer (62) is formed. Similarly, the shaft includes a recess for a shaft washer (64). The head washer (62) and shaft washer (64) function to prevent water or contaminant intrusion in the areas surrounding bolt (58).

An important aspect of the disclosure is that the improved sealing arrangements described above allow the hatch assembly (10) to be secured and sealed while using a minimal number of camlocks (66) as compared to the hatches of the prior art. In the depicted embodiments, only two cam locks (66) are utilized. This greatly reduces the time and effort needed to open and close hatch assembly (10). Furthermore, each camlock (66) includes a lever (68) that moves between two opposing stops (72). Thus, when rotating a corresponding nut on the outside of door (46, 48), the arm will rotate until it hits one of the two opposing stops (depending upon whether the cam lock (66) is being opened or closed). When lever (68) contacts a stop (72), further rotation of the nut will result in the tightening or loosening of the camlock (66). Camlock (66) can be secured with between 22 to 28 foot pounds of torque.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A sealed hatch assembly (10) adapted to secure an opening (12) for an underground enclosure (14), the hatch assembly (10) comprising:

a frame (22) having opposing lengthwise and widthwise edges (24, 26), each of the edges having a length, the opposing lengthwise edges having a midpoint (28), the frame dimensioned to be secured within the opening (12) of the underground enclosure (14), an inner peripheral extent (32) formed along the entire length of the opposing lengthwise and widthwise edges (24, 26), an upstanding L-shaped bracket (34) formed within the inner peripheral extent (32);

a center beam (36) extending between the opposing lengthwise edges (24) of the frame at the midpoint (28), the center beam (36) including an upstanding U-shaped bracket (38) extending between the opposing lengthwise edges (24), the center beam dividing the frame into two openings (42, 44);

a pair of opposing doors (46, 48), each of the doors (46, 48) being pivotally secured to one of the opposing widthwise (26) edges via a hinge assembly (52) and having an opened and closed position over a respective opening (42, 44), each of the opposing doors (46, 48) including a peripheral edge (54), a silicone gasket (56) formed within the peripheral edge (54) of each of the opposing doors (46, 48), the silicone gasket (56) adapted to engage the L-shaped (34) and U-shaped (38) brackets for form a fluid tight seal.

2. A hatch assembly adapted to secure an opening for an enclosure, the hatch assembly comprising:

a frame having first and second opposing edges, the frame dimensioned to be secured within the opening, an upstanding bracket formed along an extent of the frame;

a beam extending between the opposing edges of the frame and including an upstanding U-shaped bracket;

a first door pivotally secured to the first opposing edge via a hinge assembly and having an opened and closed position over the opening, the door including a peripheral edge, a gasket formed along an extent of the peripheral edge, the gasket adapted to engage the upstanding bracket when the door is closed to form a fluid tight seal; and a second door pivotally secured to the second opposing edge.

3. The hatch assembly as described in claim 2, wherein:

the beam is removably attached to the frame; and the upstanding U-shaped bracket engages with the gasket upon the closure of the door.

4. The hatch assembly as described in claim 3 wherein the beam is centrally located along the frame and divides the opening into two equally sized smaller openings and wherein two doors are provided for selectively closing the smaller openings.

5. The hatch assembly as described in claim 3 further comprising a pair of beam gaskets, each beam gasket being used to secure each end of the beam to the frame.

6. The hatch assembly as described in claim 2 wherein two camlocks are employed in securing the door within the frame.

7. A hatch assembly for an opening comprising:

a frame having a peripheral extent, the frame dimensioned to be secured within the opening, an upstanding bracket secured along the entire peripheral extent of the frame;

a straight beam extending from a first point along the peripheral extent to a second point along the peripheral extent, the first point being opposite the second point; and a door pivotally secured to the frame via a hinge assembly, the door having opened and closed positions over the opening, the door including a peripheral channel, a gasket secured within the peripheral channel, the gasket adapted to engage the upstanding bracket when the door is closed.

8. The hatch as described in claim 7 wherein the gasket is formed from silicone with a Shore A hardness of 10 as measured in accordance with the ASTM D2240 standard.

9. The hatch assembly as described in claim 7 wherein the beam is removably attached to the frame, the beam including an upstanding U-shaped bracket that engages with the gasket upon the closure of the door.

10. The hatch as described in claim 9 wherein a beam gasket is used to secure the beam to the frame and the beam gasket is formed from silicone with a Shore A hardness of 10 as measured in accordance with the ASTM D2240 standard.

* * * * *